US011330390B2

(12) United States Patent
Udesen et al.

(10) Patent No.: US 11,330,390 B2
(45) **Date of Patent: *May 10, 2022**

(54) METHOD FOR DETERMINING DISTANCE BETWEEN EARS OF A WEARER OF A SOUND GENERATING OBJECT AND AN EAR-WORN, SOUND GENERATING OBJECT

(71) Applicant: GN HEARING A/S, Ballerup (DK)

(72) Inventors: Jesper Udesen, Ballerup (DK); Jesper B. Boldt, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/163,572

(22) Filed: Feb. 1, 2021

(65) Prior Publication Data

US 2021/0152971 A1 May 20, 2021

Related U.S. Application Data

(63) Continuation of application No. 16/677,627, filed on Nov. 7, 2019, now Pat. No. 10,911,886, which is a (Continued)

(30) Foreign Application Priority Data

May 16, 2017 (EP) ..... 17171286

(51) Int. Cl.
*H04S 7/00* (2006.01)

(52) U.S. Cl.
CPC ..... *H04S 7/304* (2013.01); *H04S 2420/01* (2013.01)

(58) Field of Classification Search
CPC ..... H04S 7/304; H04S 2420/01
See application file for complete search history.

(56) References Cited

U.S. PATENT DOCUMENTS 10,911,886 B2 * 2/2021 Udesen ..... H04S 7/30
2011/0299707 A1 12/2011 Meyer
(Continued)

FOREIGN PATENT DOCUMENTS

CN 101835072 9/2010
CN 102318374 1/2012
(Continued)

OTHER PUBLICATIONS

Notice of Allowance for U.S. Appl. No. 16/677,627 dated Sep. 23, 2020.
(Continued)

*Primary Examiner* — Andrew L Sniezek
(74) *Attorney, Agent, or Firm* — Vista IP Law Group, LLP

(57) ABSTRACT

A sound generating object for worn by a user, includes: a first accelerometer; and a second accelerometer; wherein when the sound generating object is at an operative position, a line extending through the first and second accelerometers intersects an axis at right angle, the axis extending in an up-and-down direction, the first and second accelerometers being spaced by a known distance; wherein the first accelerometer is configured to determine a first acceleration component having a first value, and the second accelerometer is configured to determine a second acceleration component having a second value; and wherein the sound generating object is configured to determine a distance between ears of the user based on the first value of the first acceleration component determined by the first accelerometer, the second value of the second acceleration component determined by the second accelerometer, and the known distance between the first accelerometer and the second accelerometer.

22 Claims, 2 Drawing Sheets

Related U.S. Application Data continuation of application No. PCT/EP2018/062817, filed on May 16, 2018.

(56) References Cited

U.S. PATENT DOCUMENTS

| | | | | |
|---|---|---|---|---|
| 2013/0177166 | A1 | 7/2013 | Agevik | |
| 2016/0269849 | A1 | 9/2016 | Riggs | |
| 2017/0013389 | A1 | 1/2017 | Kitazawa | |
| 2020/0252740 | A1 | 8/2020 | Hammerschmidt | |
| 2021/0211829 | A1* | 7/2021 | Riggs | H04R 5/033 |

FOREIGN PATENT DOCUMENTS

| | | |
|---|---|---|
| CN | 103697859 | 4/2014 |
| CN | 106162499 | 11/2016 |
| WO | WO 99/14985 | 3/1999 |
| WO | WO 2016/089133 | 6/2016 |
| WO | WO 2018/210974 | 11/2018 |

OTHER PUBLICATIONS

Foreign OA for CN Patent Appln. No. CN 201880039493.6 dated Oct. 23, 2020.

Extended European Search Report dated Nov. 11, 2017 for corresponding European Application No. 17171286.2.

International Search Report and WO dated Aug. 3, 2018 for corresponding International Application No. PCT/EP2018/062817.

* cited by examiner

METHOD FOR DETERMINING DISTANCE BETWEEN EARS OF A WEARER OF A SOUND GENERATING OBJECT AND AN EAR-WORN, SOUND GENERATING OBJECT

RELATED APPLICATION DATA

This application is a continuation of U.S. patent application Ser. No. 16/677,627 filed on Nov. 7, 2019, now U.S. Pat. No. 10,911,886, which is a continuation of International Patent Application No. PCT/EP2018/062817 filed on May 16, 2018, which claims priority to, and the benefit of, European Patent Application No. 17171286.2 filed on May 16, 2017. The entire disclosures of all of the above applications are expressly incorporated by reference herein.

TECHNICAL FIELD

The disclosure primarily relates to a method for determining distance between ears of a wearer of a sound generating object.

BACKGROUND

In the art of virtual sound presentation by means of devices such as headsets, hearing aids or hearables, it is desirable that a listener has access to externalized sound, i.e. sound containing spatial cues. These spatial cues are typically generated by the software on the basis of the information available in electrical audio signals. The illusion of a virtual sound source, external with respect to the listeners head, is hereby created.

In order to obtain satisfactory user experience in this regard, it is necessary to accurately establish physical, i.e. Euclidean, distance between the two ears of the listener. This is e.g. the case if generic Head-Related-Transfer-Function (HRTF) needs to be adjusted to match the geometry of the user's head. A related example involves bilateral beamformers where the head size, represented by the ear-to-ear distance, is an important input parameter for more advanced beamforming applications.

Obviously, manual measurement of the ear-to-ear distance is available, but is cumbersome and prone to delivering inaccurate result.

EP 2 890 161 presents a method of determining acoustic head size of a user wearing a pair of hearing aids. Minimum requirement in terms of equipment to arrive at the solution is to employ two hearing instruments and an intermediate signal provider, typically a mobile telephone. These devices communicate with each other using audio signals in order to determine acoustic time delay between the two ears so as to estimate the acoustic head size. Here, acoustic head size may be defined as an acoustic distance between a pair of customarily arranged hearing aids. This acoustic distance is derived from the value of the time delay associated with the acoustic signals captured by the microphones of the respective hearing aid.

SUMMARY

One objective at hand is therefore to at least alleviate drawbacks associated with the current art.

The above stated objective is achieved by means of the method for determining distance between ears of a wearer of a sound generating object and an ear-worn, sound generating object according to the independent claims, and by the embodiments according to the dependent claims.

More specifically, a first aspect of the present disclosure provides a method for determining a distance (D) between ears of a wearer of a sound generating object, the method comprising: selecting a model for representing shape of the head of the wearer of the sound generating object so as to obtain a center axis of the wearer's head; associating the first sound generating object with an ear of the wearer, wherein the first sound generating object comprises a first accelerometer and a second accelerometer, the respective accelerometers, i.e. the first accelerometer and the second accelerometer, being arranged to measure at least an acceleration component (a1, a2) intersecting at a substantially right angle a center axis of the wearer's head, wherein the first and second accelerometers are so arranged that a straight line that intersects the center axis of the wearer's head at a substantially right angle crosses the first and second accelerometers such that the acceleration components (a1, a2) have the same direction, the first and second accelerometers being spaced by a known distance ($\Delta r$); when the head of the wearer is in motion, determining, by means of the first accelerometer, a value of the first acceleration component (a1) and, by means of the second accelerometer, a value of the second acceleration component (a2), determining the distance (D) between the ears of the wearer on the basis of the obtained values of the acceleration components (a1, a2). In one or more exemplary methods, determining the distance (D) between the ears of the wearer is based on the model. In one or more exemplary methods, determining the distance (D) between the ears of the wearer is based on the known distance between the first accelerometer and the second accelerometer.

Here, the term distance is in the context of the present application to be construed as Euclidean distance, i.e. a straight-line distance between two points in space. In this context, this Euclidian distance cannot be correlated with the above-discussed acoustic distance. Further, center axis of the wearer's head is an axis substantially perpendicular to a horizontal, ground plane, said axis further intersecting a head pivot point, i.e. a point around which the head rotates side to side. Moreover, associating the first sound generating object with an ear of the wearer entails arranging said object at or in proximity of the ear.

In the following, positive effects and advantages of one or more embodiments are presented with reference to the first aspect.

By executing the method in accordance with the above, an automatic adjustment of the distance between the ears of the wearer may be achieved. In other words, no involvement of the user is required in order to handily and accurately determine the ear-to-ear distance. Moreover, said method is due to its inherent simplicity easily integrated in the existing software. Ultimately, the effect conferred by the inventive method is the improved fidelity with respect to presentation of the virtual (3D) audio signals generated by the sound generating object.

In addition, by accurately and automatically determining the head size, more advanced beamforming models may be employed in the sound generating object, in particular in the hearing aid. In a related context, estimation of the direction of arrival (DOA) of the speech signal could be significantly improved when the head size is accurately determined.

In another aspect of the present disclosure, a first, ear-worn, sound generating object is provided, wherein the first, ear-worn, sound generating object comprises means for allowing the wearer of the sound generating object to select a model for representing shape of the head so as to obtain a center axis of the wearer's head, a first accelerometer and a second accelerometer, the respective accelerometers, i.e. the first accelerometer and the second accelerometer, being arranged to measure at least an acceleration component (a1, a2) intersecting at a substantially right angle the center axis of the wearer's head, wherein the first and second accelerometers are so arranged that a straight line that intersects the center axis of the wearer's head at a substantially right angle crosses the first and second accelerometers such that the acceleration components (a1, a2) have the same direction, the first and second accelerometers being spaced by a known distance (Δr), wherein the first accelerometer is provided with means for determining a value of a first acceleration component (a1) and the second accelerometer is provided with means for determining a value of a second acceleration component (a2), and wherein the first, ear-worn, sound generating object (4) is provided with means for determining, on the basis of the obtained values of the acceleration components (a1, a2), a distance (D) between the ears of the wearer.

In one or more exemplary first, ear-worn, sound generating objects, the means for determining the distance (D) between the ears of the wearer comprises means for determining the distance (D) between the ears of the wearer based on the model. In one or more exemplary first, ear-worn, sound generating objects, the means for determining the distance (D) between the ears of the wearer comprises means for determining the distance (D) between the ears of the wearer based on the known distance between the first accelerometer and the second accelerometer.

Further advantages and features of embodiments will become apparent when reading the following detailed description in conjunction with the drawings

DETAILED DESCRIPTION OF THE PREFERRED EMBODIMENTS

Figure 2:
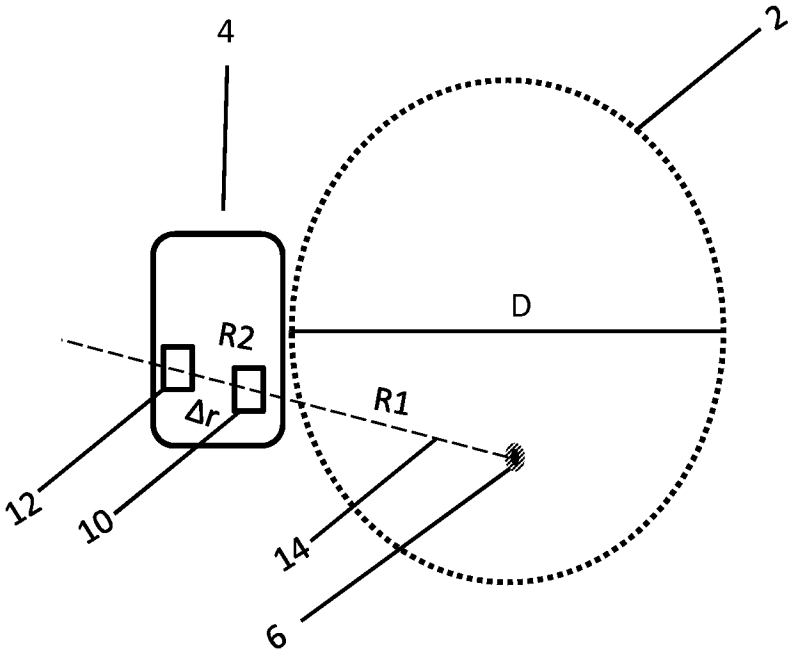
FIG. 2 is a close-up of an accelerometer configuration according to one embodiment.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

A method for determining a distance (D) between ears of a wearer of a sound generating object is disclosed. The method comprises selecting a model for representing shape of the head of the wearer of the sound generating object so as to obtain a center axis of the wearer's head.

The method comprises associating, such as arranging or positioning, the first sound generating object with an ear of the wearer, wherein the first sound generating object comprises a first accelerometer and a second accelerometer, the respective accelerometers being arranged to measure at least an acceleration component (a1, a2) intersecting at a substantially right angle the center axis of the wearer's head, wherein the first and second accelerometers are so arranged that a straight line that intersects the center axis of the wearer's head at a substantially right angle crosses the first and second accelerometers such that the acceleration components (a1, a2) have the same direction, the first and second accelerometers being spaced by a known distance. Thus, it is clear that the first sound generating object is positioned or arranged at or near the wearer's ear, such as behind-the-ear, in-the-ear or partly within the ear.

The method comprises determining, by means of the first accelerometer when the head of the wearer is in motion, a value of a first acceleration component (a1) and, by means of the second accelerometer, a value of a second acceleration component (a2), and determining the distance (D) between the ears of the wearer on the basis of the model, the obtained values of the first and second acceleration components (a1, a2), and the known distance between the first accelerometer and the second accelerometer.

The first acceleration component may intersect at a substantially right angle the center axis of the wearer's head and/or the straight line crossing the first accelerometer and the second accelerometer. In other words, the first acceleration component may form a substantially right angle with the center axis of the wearer's head and/or the straight line crossing the first accelerometer and the second accelerometer.

The second acceleration component may intersect at a substantially right angle the center axis of the wearer's head and/or the straight line crossing the first accelerometer and the second accelerometer. In other words, the second acceleration component may form a substantially right angle with the center axis of the wearer's head and/or the straight line crossing the first accelerometer and the second accelerometer.

In the method, the distance (D) may be determined as a function of time and averaged over a time interval. The length of the time interval may be at least 60 seconds.

Also disclosed is a (first) ear-worn, sound generating object comprising means for allowing the wearer of the sound generating object to select a model for representing shape of the head so as to obtain a center axis of the wearer's head; a first accelerometer and a second accelerometer, the respective accelerometers being arranged to measure at least an acceleration component (a1, a2) intersecting at a substantially right angle the center axis of the wearer's head, wherein the first and second accelerometers are so arranged that a straight line that intersects the center axis of the wearer's head at a substantially right angle crosses the first and second accelerometers such that the acceleration components (a1, a2) have the same direction, the first and second accelerometers being spaced by a known distance; wherein the first accelerometer is provided with means for determining a value of a first acceleration component (a1) and the second accelerometer (12) is provided with means for determining a value of a second acceleration component (a2); and wherein the ear-worn, sound generating object is provided with means for determining, on the basis of the obtained values of the first and second acceleration components (a1, a2), a distance (D) between the ears of the wearer. The distance (D) between the ears of the wearer may be based on the model. The distance (D) between the ears of the wearer may be based on the known distance between the first accelerometer and the second accelerometer.

In other words, the sound generating object is configured to, when worn at the ear of the user, determine the distance (D) between the ears of the wearer based on first acceleration component and the second acceleration component. The acceleration components are determined in a plane substantially perpendicular to the center axis.

The first, ear-worn, sound generating object may be a hearing instrument.

The sound generating object may be enclosed by an earpad belonging to a headphone. Thus, a headphone comprising an earpad is disclosed, the earpad enclosing the sound generating object.

The sound generating object may be an ear piece being part of a headset. Thus, a headset comprising an ear piece is disclosed, the earpiece comprising a sound generating object as disclosed herein.

The sound generating object may be a hearable.

Also disclosed is use of a first accelerometer and a second accelerometer in an ear-worn, sound generating object as disclosed herein in order to determine a distance (D) between the ears of the wearer, wherein the respective accelerometers are arranged to measure at least an acceleration component (a1, a2) intersecting at a substantially right angle a center axis of the wearer's head, wherein the first accelerometer is spaced from the second accelerometer by a known distance, and wherein the first accelerometer is provided with means for determining a value of a first acceleration component (a1) and the second accelerometer is provided with means for determining a value of a second acceleration component (a2), when the head (2) of the wearer is in motion.

Figure 1:
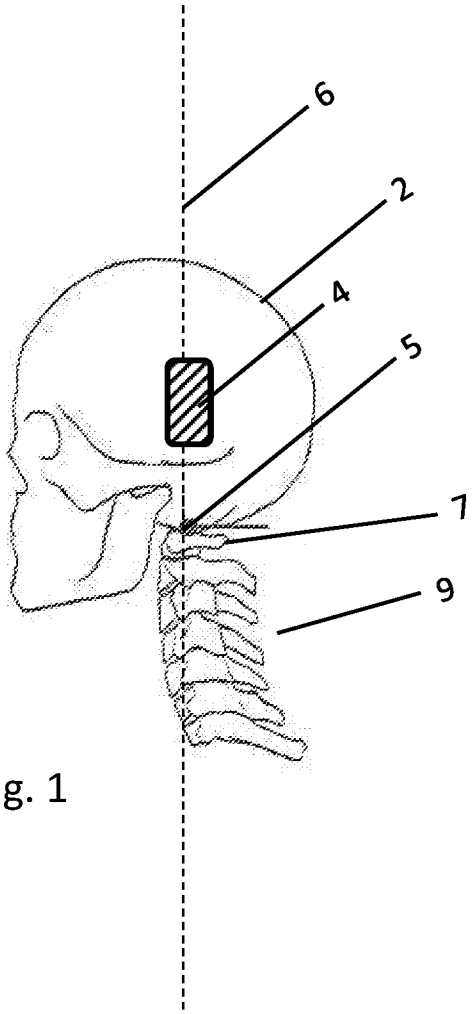
FIG. 1 is a perspective view of a head of a user schematically showing an ear-worn, sound generating object.

FIG. 1 is a perspective view of a head 2 of a user schematically showing an ear-worn, sound generating object 4. More specifically, a skull and a portion of a spine 9 including cervical vertebrae is illustrated. Further, a center axis 6 of the wearer's head and a corresponding head pivot point 5 are shown. As defined above, the center axis 6 is an axis substantially perpendicular to a horizontal, ground plane, and it intersects the head pivot point 5, i.e. a point around which the head rotates side to side. As it may be seen, the head pivot point 5 is positioned at an interface of the skull and the topmost vertebrae 7, also called atlas. The ear-worn, sound generating object 4 is also shown. Here, said object may be chosen from the group comprising hearing instruments, earpads belonging to a headphone, ear pieces being part of a headset or hearables. Relevant structural features of the sound generating object will be more thoroughly described in conjunction with FIG. 2.

For certain applications it is possible, albeit tedious, to precisely determine the head pivot point in real life. The position of the center axis is subsequently determined on the basis of this information. However, a more convenient approach is to approximate the shape of the head with that of a well-known geometric body, e.g. a cylinder, an ellipsoid or a sphere, having a known pivot point/position of the center axis. These approximations and their implications on the parameters such as head pivot point are well known to the artisan. For the purposes of one or more embodiments described herein, an approximate model in accordance with the above delivers sufficient precision and is easily integrated into the surrounding software infrastructure.

FIG. 2 is a close-up of an accelerometer configuration according to an embodiment. The configuration is shown in top view and the center axis extends perpendicularly to the plane of the paper. A sound generating object, here a hearing aid, is schematically shown. The hearing aid comprises a first and a second accelerometers, the respective accelerometer being arranged to measure at least an acceleration component (a1, a2) intersecting at a substantially right angle a center axis of the wearer's head. Further, the two accelerometers are so arranged that a straight line that intersects the center axis of the wearer's head at a substantially right angle crosses the two accelerometers. The accelerometers are spaced by a known distance (Δr). In hearing aids, this distance is, due to spatial constraints, typically below 10 mm, preferably between 5 and 8 mm.

Using the above set-up and in order to determine the distance (D) between the ears of the wearer, the accelerations measured with the two accelerometers are $a_{meas1}(t)$ and $a_{meas2}(t)$ and the distance (Δr) is a known distance. Now, the distances to be calculated are, firstly, a distance $R_1$ from the center axis of the head to a first accelerometer and the corresponding distance $R_2$ to a second accelerometer, where $R_2>R_1$, i.e. $R_1$ is positioned closer to the center axis than $R_2$. As discussed in connection with FIG. 1, position of the center axis of the wearer's head is obtained when the wearer of the sound generating object selects a model for representing shape of the head. $R_2$ and $R_1$ are calculated in the following manner once the user starts to rotate his head:

The magnitude of the angular acceleration originating from the head rotation is $a_0$ at a given time $t_0$.

Since $a_0$ is constant for the entire head (at time $t_0$) we have:

$$\alpha_0 = \frac{a_{meas2}}{R_2} = \frac{a_{meas1}}{R_1} \tag{1}$$

Combined with $\Delta r=R_2-R_1$ we have two equations with two unknowns that we can solve for $R_1$:

$$R_1 = \frac{\Delta r}{\frac{a_{meas2}}{a_{meas1}} - 1} \tag{2}$$

The distance D will now be:

$$D = 2R_1 = \frac{2\Delta r}{\frac{a_{meas2}}{a_{meas1}} - 1} \tag{3}$$

By executing the method in accordance with the above, an automatic adjustment of the distance (D) between the ears of the wearer may be achieved. In other words, no involvement of the user is required in order to handily and accurately determine the ear-to-ear distance. Moreover, said method is due to its inherent simplicity easily integrated in the existing software. Ultimately, the effect conferred by the inventive method is the improved fidelity with respect to presentation of the virtual (3D) audio signals generated by the sound generating object. In addition, by accurately and automatically determining the head size, more advanced beamformers may be employed. In a related context, estimation of the direction of arrival (DOA) of the speech signal could be significantly improved when the head size is accurately determined.

Even better, less noisy results may be obtained when the distance (D) is determined as a function of time and averaged over a time interval. Typically, the length of the time interval is at least 60 seconds. In certain applications, even longer time intervals may be used.

In the above context, hearing aids carrying two accelerometers are known in the art. In particular, such a set-up is disclosed in WO9914985 attempting to reduce vibrations in the miniature hearing aids. To this purpose, two accelerometers are arranged in a hearing aid of the completely-in-the-canal-type (CIC). The accelerometers are so positioned within the hearing aid so that they are physically secured to its housing since they measure vibrations that arise due to feedback loop in the hearing aid. Otherwise, their position in the hearing aid is completely arbitrary.

Figure 3:
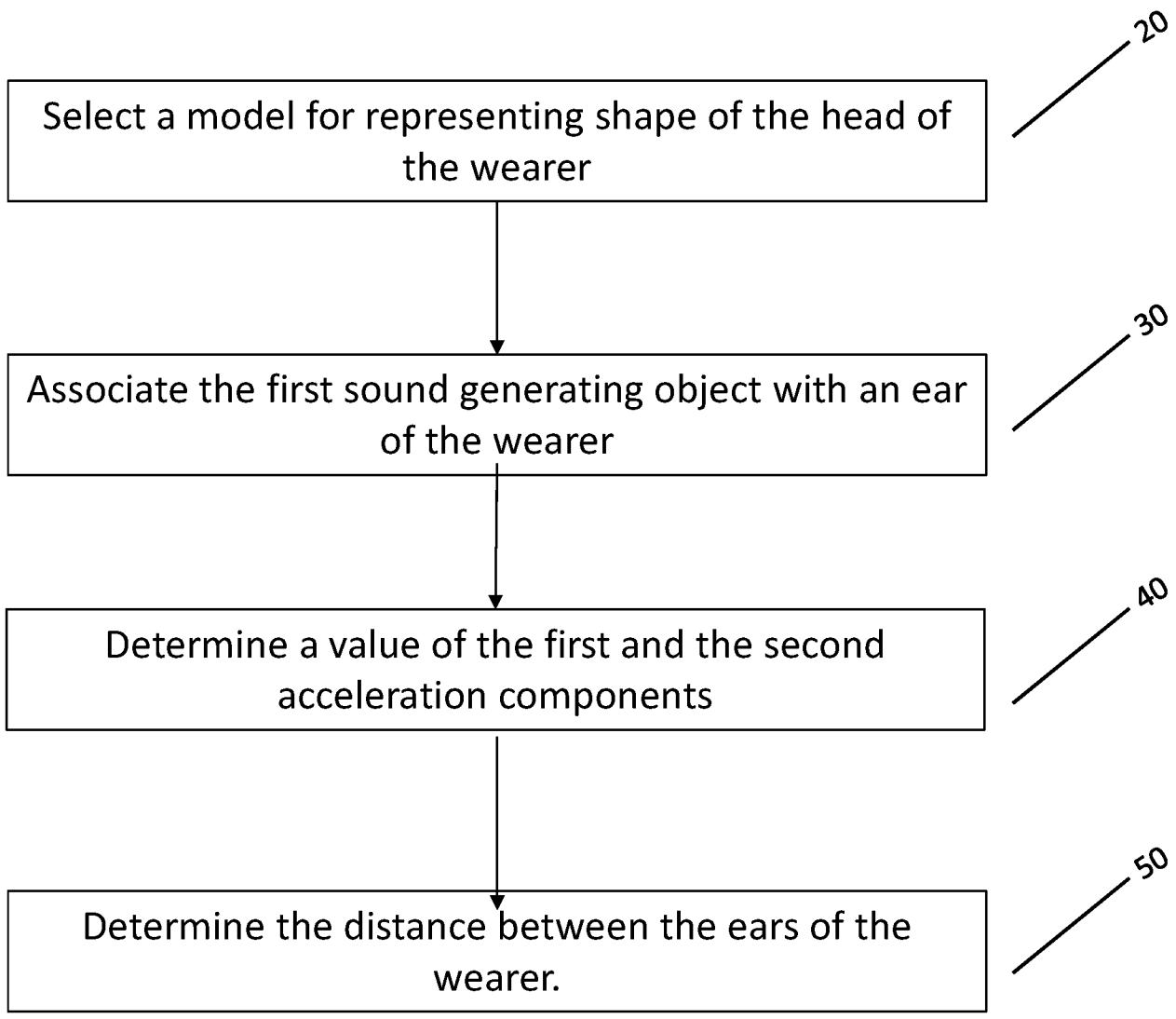
FIG. 3 is a flow chart illustrating method steps according to one embodiment.

FIG. 3 is a flow chart illustrating a method for determining a distance (D) between ears of a wearer of a sound generating object, according to one embodiment. The method may be performed in a device such a hearing aid, hearable or a headphone. In particular, the applications where accelerometers are integrated in hearing aids are experiencing increased interest from the industry. The method comprises to select 20 a model for representing shape of the head of the wearer of the sound generating object means for allowing the wearer of the sound generating object to select a model for representing shape of the head so as to obtain a center axis of the wearer's head. According to the preferred models, the shape of the head is approximated by a well-known geometric body, e.g. a cylinder, an ellipsoid or a sphere. An approximate model in accordance with the above provides sufficient precision and is easily integrated into the surrounding software infrastructure. Subsequently, the method comprises to associate 30 the first sound generating object with an ear of the wearer, wherein the first sound generating object comprises a first accelerometer and a second accelerometer, the respective accelerometers being arranged to measure at least an acceleration component (a1, a2) intersecting at a substantially right angle a center axis of the wearer's head, said two accelerometers being spaced by a known distance (Δr). The method further comprises to, when the head of the wearer is in motion, determine 40, by means of the first accelerometer, a value of the first acceleration component (a1) intersecting at a substantially right angle a center axis of the wearer's head and, by means of the second accelerometer, a value of the second acceleration component (a2) intersecting at a substantially right angle a center axis of the wearer's head. The method also comprises to, on the basis of the obtained values of the acceleration components (a1, a2), determine 50 the distance (D) between the ears of the wearer.

Also disclosed are methods, ear-worn, sound generating objects, and use thereof according to any of the following items.

Item 1. A method for determining a distance (D) between ears of a wearer of a sound generating object (4), the method comprising the steps of:

select (20) a model for representing shape of the head (2) of the wearer of the sound generating object (4) so as to obtain a center axis (6) of the wearer's head, associate (30) the first sound generating object (4) with an ear of the wearer, wherein the first sound generating object (4) comprises a first (10) and a second (12) accelerometers, the respective accelerometer (10, 12) being arranged to measure at least an acceleration component (a1, a2) intersecting at a substantially right angle the center axis (6) of the wearer's head, wherein the two accelerometers (10, 12) are so arranged that a straight line (14) that intersects the center axis (6) of the wearer's head at a substantially right angle crosses the two accelerometers (10, 12) such that the acceleration components (a1, a2) have the same direction, said two accelerometers (10, 12) being spaced by a known distance (Δr), when the head (2) of the wearer is in motion, determine (40), by means of the first accelerometer (10), a value of the first acceleration component (a1) and, by means of the second accelerometer (12), a value of the second acceleration component (a2), on the basis of the obtained values of the acceleration components (a1, a2), determine (50) the distance (D) between the ears of the wearer.

Item 2. A method according to item 1, wherein the distance (D) is determined as a function of time and averaged over a time interval.

Item 3. A method according to item 2, wherein the length of the time interval is at least 60 seconds.

Item 4. A first, ear-worn, sound generating object (4), said object comprising:

means for allowing the wearer of the sound generating object to select a model for representing shape of the head (2) so as to obtain a center axis (6) of the wearer's head, a first and a second accelerometers (10, 12), the respective accelerometer being arranged to measure at least an acceleration component (a1, a2) intersecting at a substantially right angle the center axis of the wearer's head (2), wherein the two accelerometers (10, 12) are so arranged that a straight line (14) that intersects the center axis (6) of the wearer's head at a substantially right angle crosses the two accelerometers (10, 12) such that the acceleration components (a1, a2) have the same direction, said two accelerometers (10, 12) being spaced by a known distance (Δr), wherein the first accelerometer (10) is provided with means for determining a value of the first acceleration component (a1) and the second accelerometer (12) is provided with means for determining a value of the second acceleration component (a2), said object (4) further being provided with means for determining, on the basis of the obtained values of the acceleration components (a1, a2), a distance (D) between the ears of the wearer.

Item 5. The first, ear-worn, sound generating object (4) according to item 4, wherein the sound generating object is a hearing instrument.

Item 6. The first, ear-worn, sound generating object (4) according to item 4, wherein the sound generating object is enclosed by an earpad belonging to a headphone.

Item 7. The first, ear-worn, sound generating object (4) according to item 4, wherein the sound generating object is an ear piece being part of a headset.

Item 8. The first, ear-worn, sound generating object (4) according to claim item 4, wherein the sound generating object is a hearable.

Item 9. Use of a first and a second accelerometers (10, 12) in an ear-worn, sound generating object (4) according to any of the items 4-8 in order to determine a distance (D) between the ears of the wearer, wherein the respective accelerometer is arranged to measure at least an acceleration component (a1, a2) intersecting at a substantially right angle a center axis (6) of the wearer's head, said two accelerometers being spaced by a known distance (Δr), and wherein the first accelerometer is provided with means for determining a value of the first acceleration component (a1) and the second accelerometer is provided with means for determining a value of the second acceleration component (a2), when the head (2) of the wearer is in motion.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

The invention claimed is:

1. A sound generating object for worn by a user, the sound generating object comprising:

a first accelerometer; and a second accelerometer;

wherein a line extending through the first and second accelerometers intersects an axis of a head of the user, the first and second accelerometers being spaced by a preset distance;

wherein the first accelerometer is configured to determine a first acceleration component having a first value, and the second accelerometer is configured to determine a second acceleration component having a second value; and wherein the sound generating object is configured to determine a distance between ears of the user based on the first value of the first acceleration component determined by the first accelerometer, and the second value of the second acceleration component determined by the second accelerometer;

wherein the preset distance is below 10 mm.

2. The sound generating object according to claim 1, wherein the first accelerometer and the second accelerometer are configured for placement on a same side of the head of the user.

3. The sound generating object according to claim 1, wherein the first acceleration component and the second acceleration component have a same direction.

4. The sound generating object according to claim 1, wherein the axis comprises a center axis of the head of the user.

5. The sound generating object according to claim 4, wherein the center axis of the head extends through a head pivot point.

6. The sound generating object according to claim 1, wherein the axis is a vertical axis.

7. The sound generating object according to claim 1, wherein the first acceleration component forms a right angle with the axis.

8. The sound generating object according to claim 1, wherein the sound generating object is configured to determine the distance between ears of the user also based on a model representing the head of the user.

9. The sound generating object according to claim 1, wherein the sound generating object is a hearing instrument.

10. The sound generating object according to claim 1, wherein the sound generating object is enclosed by an earpad for a headphone.

11. The sound generating object according to claim 1, wherein the sound generating object is an ear piece for a headset.

12. The sound generating object according to claim 1, wherein the sound generating object is a hearable.

13. The sound generating object according to claim 1, wherein the sound generating object is a hearing aid.

14. The sound generating object according to claim 1, further comprising a model representing the head of the user.

15. The sound generating object according to claim 14, wherein the model represents a shape of the head.

16. The sound generating object according to claim 14, wherein the axis comprises a center axis of the head of the user, and wherein the model defines the center axis.

17. The sound generating object according to claim 14, further comprising a user interface configured to allow the user to select the model representing the head of the user.

18. A method performed by the sound generating object of claim 1 to determine the distance between the ears of the user, comprising:

determining the first value of the first acceleration component by the first accelerometer;

determining the second value of the second acceleration component by the second accelerometer.

wherein the act of determining the first value of the first acceleration component, and the act of determining the second value of the second acceleration component are performed when the head of the user is in motion.

19. A method of determining a distance between ears of a user of a sound generating object, the sound generating object having a first accelerometer and a second accelerometer, the first and second accelerometers being separated by a preset distance, wherein a line extending through the first and second accelerometers intersects an axis of a head of the user, the method comprising:

determining a first acceleration component having a first value by the first accelerometer;

determining a second acceleration component having a second value by the second accelerometer; and determining the distance between the ears of the wearer based on the first value of the first acceleration component, and the second value of the second acceleration component;

wherein the determined distance comprises an averaged distance over a time interval.

20. The method according to claim 19, wherein the distance between the ears is determined as a function of time.

21. The method according to claim 19, wherein a length of the time interval is at least 60 seconds.

22. The method according to claim 19, wherein the distance between the ears of the user is determined also based on a model representing the head of the user.

* * * * *